United States Patent [19]

Weiblen

[11] Patent Number: 4,610,293

[45] Date of Patent: Sep. 9, 1986

[54] DEVICE FOR HEAT INSULATION AND AIR CONDITIONING

[76] Inventor: Rolf-Diether Weiblen, Eltener Strasse 1, D-4330 Mülheim a.d. Ruhr, Fed. Rep. of Germany

[21] Appl. No.: 605,170

[22] Filed: Apr. 30, 1984

[30] Foreign Application Priority Data

May 4, 1983 [DE] Fed. Rep. of Germany ..... 3316263

[51] Int. Cl.[4] ..... E06B 9/08

[52] U.S. Cl. ..... 160/120; 160/273 R

[58] Field of Search ..... 160/120, 121, 122, 266, 160/241, 85, 86, 25

[56] References Cited

U.S. PATENT DOCUMENTS

| | | | |
|---|---|---|---|
| 2,848,064 | 8/1958 | Gregory et al. | 160/241 X |
| 3,980,122 | 9/1976 | Takazawa | 160/120 X |
| 4,194,550 | 3/1980 | Hopper | 160/121 R |
| 4,273,099 | 6/1981 | Morgan | 160/86 X |
| 4,313,484 | 2/1982 | Shore | 160/121 R |
| 4,368,771 | 1/1983 | Hopper | 160/121 R |
| 4,418,739 | 12/1983 | Woolnough et al. | 160/120 |
| 4,453,584 | 6/1984 | Steele | 160/121 R |
| 4,506,720 | 3/1985 | Iwanicki | 160/121 R X |
| 4,516,618 | 5/1985 | Gardner et al. | 160/120 |

*Primary Examiner*—Ramon S. Britts
*Assistant Examiner*—David M. Purol
*Attorney, Agent, or Firm*—Birch, Stewart Kolasch & Birch

[57] ABSTRACT

The invention relates to a device for heat insulation and air conditioning of structural assemblies, in particular of windows etc., comprising a first driven winding roller (4), arranged at a first end for a windable flexible wall and deviating rollers arranged at the second end, the deviating rollers at the second end being supported stationarily and a second winding roller being provided which can be rotated simultaneously with the first winding roller. The longitudinal edges of the first wall are fitted with wall guiding profiles clamping between them, over part of their length, a web material, being constantly present in the guide profiles as well as being adapted to be redirected repeatedly by the deviating rollers so that a varying number of tightly closed air chambers can be formed optionally in a space. The web material of the flexible wall may consist of successively disposed materials having different properties of transparency, reflectivity and absorption. Upon demand, the air chambers may be ventilated in the space so that e.g. in summer, warm air may be conducted to the outside or to a heat exchanger.

18 Claims, 6 Drawing Figures

DEVICE FOR HEAT INSULATION AND AIR CONDITIONING

Figure 1:
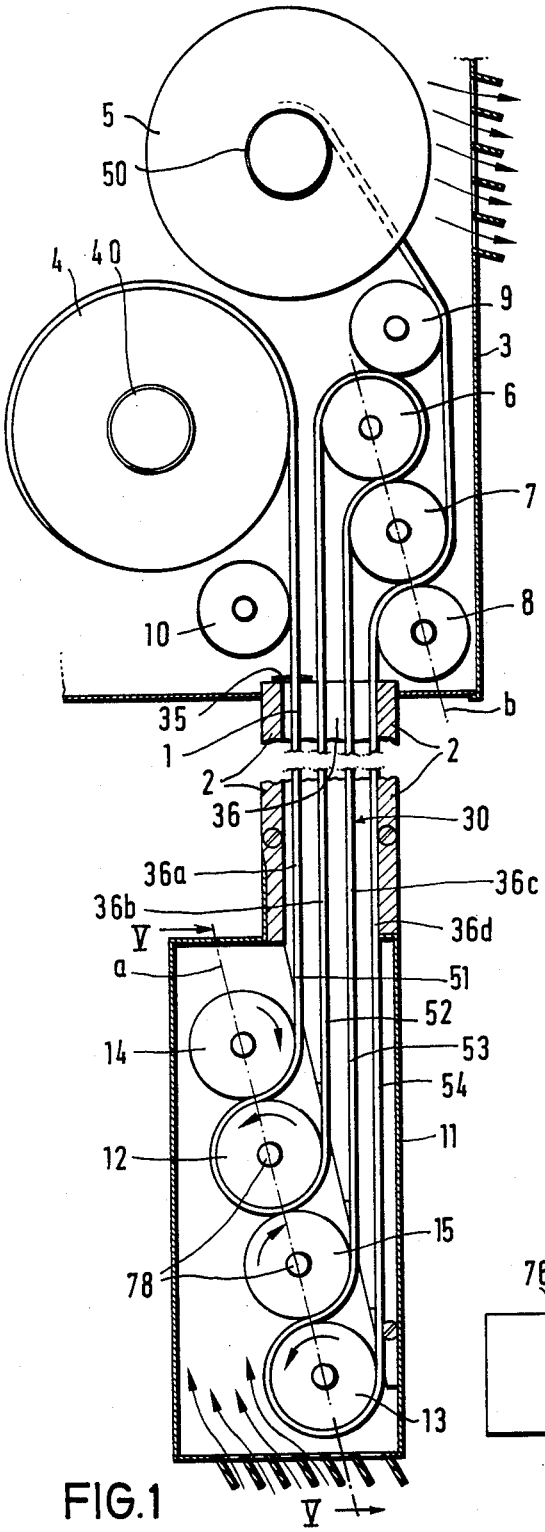

The present invention relates to a device for the heat insulation and air conditioning of structural assemblies, in particular of windows or the like comprising, for a windable flexible wall, a first driven winding means arranged at a first end and a deviating means arranged at the second end.

Such devices of the roller curtain type are used for internal and external heat insulation and also as sunshades and screens. Heat loss or heat accumulation in buildings is mostly caused by windows. While a good inward and outward heat insulation is realized by the outer walls, the insulation of windows—even if provided with insulating or multiple glass—is considerably worse. Subject to the outer temperature in relation to room temperature accepted as agreeable, it would be desirable that heat transmission zones, (e.g.) window (surfaces), either admit or restrict the heat passage in a valve-like manner. For instance in summer, with solar radiation, it is desirable to have a high reflection of sunlight to the outside and an insulation as perfect as possible to the inside, while in winter, with solar radiation, the window surface serves as a solar collector and the insulation to the outside should be as perfect as possible. Due to the conditions of day and night, different properties as to heat transmission are desirable for a window surface.

A known roller curtain type (Austrian Patent No. 301 827) consists of a winding means, a sheet web and a holder bar for the end of the sheet web which extends as a sagging loop to house a deviating roller that, due to its weight, keeps the sheet web tightened in a longitudinal direction. By deviation, the roller curtain is always double-layered when introduced into the path of light and heat radiation, thus it is only possible to either cover the total window surface or only part thereof by the rolling curtain. However, the air chamber at the lateral edges of the sheet can be sealed although with such a curtain.

There has been also known a heat-insulating curtain (U.S. Pat. No. 4,313,484) consisting of several webs and being spreadable in front of a window or door surface, its lower end comprising apertures to allow air present in the air chambers formed by the curtain to flow out when the curtain is wound up. The curtain itself consists of a material which is inflated automatically like a balloon if variations in temperature occur thus increasing the volume of the air chambers and causing the formation of a thick heat-insulating layer of air present in them. Each sheet web is redirected at the lower end of the curtain about the deviating roller, the outer sheet web being adapted to receive internally additional sheet webs of which one also contains a deviating roller provided in a loop the diameter of which is lower to that of the outer sheet web. Due to the deviating rollers of varying diameters, a minimum distance between the guided sheet web portions is achieved. At the same time, the weight of the rollers contributes to a tightened curtain in the longitudinal direction. However, these known curtains do not permit a sufficient sealing of each individual air chamber with stationary edge guidances.

It is therefore the object of the present invention to provide a device of the kind mentioned at the outset hereof which, by means of one sole flexible wall, optionally produces a varying number of tightly closed air chambers. To solve this problem, the invention is characterized in that the deviating means is stationarily supported at the second end, that a second winding device is provided which can be rotated simultaneously with the first winding device, that the edges of the flexible wall are conducted in lateral guiding rails and that on part of its length, the flexible wall contains an opening.

By the stationary support at the second end of the deviating means, each individual web of the deviated flexible wall can be laterally conducted over the total height and one section of the flexible wall is constantly contained in the guiding rails. Thus, with a flexible wall in the form of a continuous web, all chambers formed by the deviation of the flexible wall would be constantly closed. To permit an optional opening of one or several air chambers, there is provided an aperture limited laterally by strip-shaped sections of the flexible wall. These sections, extending continuously over the total length of the flexible wall, are conducted in guiding rails.

Preferably, the two winding means are arranged at the same end. Only one end of the device need be provided with a larger box to receive the winding means while the deviating means is disposed at the opposite end.

The distance between both winding means may be inferior less than to the sum of the maximum radii of the wound up packages of the flexible wall. The wound package of a winding means may engage the winding range of the other winding means which then will be unwound totally or in part thus permitting a saving in space.

In a preferred embodiment, at least two pairs of deviating rollers are arranged at the first end, one pair of deviating rollers being fitted at the second end. As a result thereof, the flexible wall can be introduced in several layers into the path of light and heat radiation. Moreover, by the pairs of deviating rollers, the distances between the individual parallel sections of the flexible wall may be adjusted conveniently so that chambers of equal or different thickness can be created.

According to a preferred embodiment of the present invention, the longitudinal edges of the flexible wall comprise wall guiding profiles to ensure a perfect sliding of the flexible wall in lateral guide rails and a trouble-free winding onto the winding means.

It is possible to extend the flexible wall guiding profiles beyond the web material end in the form of a leader and final portion. While the web material between the wall guiding profiles is interrupted, i.e. it does not extend over the total length of the flexible wall, the wall guiding profiles are continuous. With a respective length of the leader, the web material can be completely wound up even with repeated deviation of the flexible wall.

According to an another embodiment of the present invention, the wall guiding profile consists of two protective strips forming a slot to receive the flexible web material, and a bilaterally flattened thicker portion in parallel to the material and averted from the slot. Due to the protective strips, the web material is prevented from being hooked in the guide rails and protected at the same time. Since the thicker portion or bulge of the wall guiding profile is flattened bilaterally in parallel to the flexible wall, they may be superimposed much better when wound up.

The bulge portion may contain a central reinforcing core to receive tractive forces. Thus, there will be no risk that the wall guiding profiles and the wall material will be overstrained with a tractive load, in particular, when the device is started.

In another embodiment of the present invention, the bulge portion of the wall guiding profile is a honeycomb-shaped hexagonal profile.

The wall guiding profile may be displaceable laterally in the guide rail in the plane of the flexible wall. By this means, web material elongations due to heat action can be compensated.

According to still another embodiment of the present invention, there are provided in the guide rails of a hollow profile design, guide elements to receive the wall guiding profile which are supported at the slot edges of the guide rails by clamping elements. As a result, the web material may be kept under transverse tension even in case of its expansion under heat action.

The circumferential faces of the deviating rollers may be profiled for the receipt of the sheet guide profile to ensure that the flexible wall cannot leave the roller guidances.

In a further advantageous configuration, there is coordinated to at least one pair of deviating rollers a pair of pressing rollers determining the course of a section of wall guiding profiles leading to the pair of deviating rollers. By means of the pair of pressing rollers, the distance between the individual webs of the flexible wall is reduced so that the space requirement for the formation of several chambers in the path of light and heat radiation is reduced.

Other advantageous features of the present invention can be noted from the claims.

With reference to the drawings, one embodiment of the present invention will be described more closely as follows hereinafter.

Figure 6:
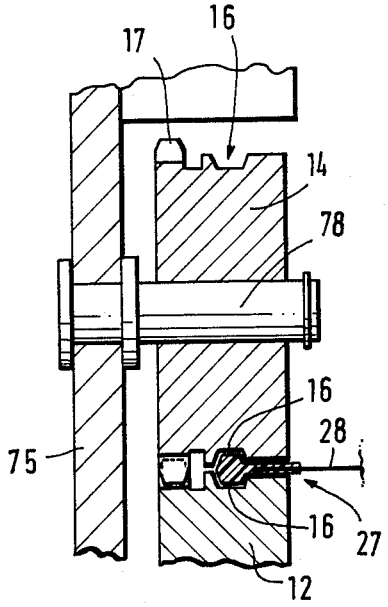
Figure 5:
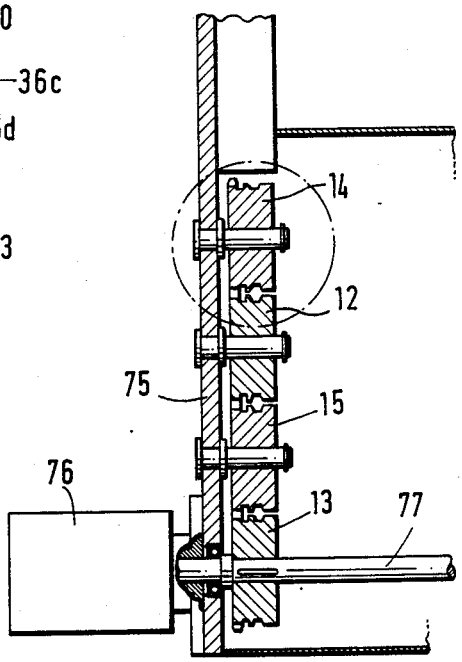
Figure 4:
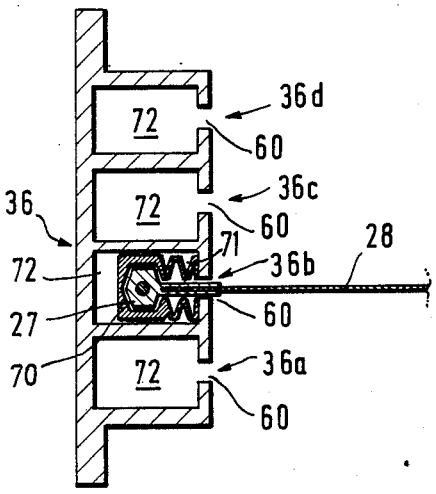
Figure 3:
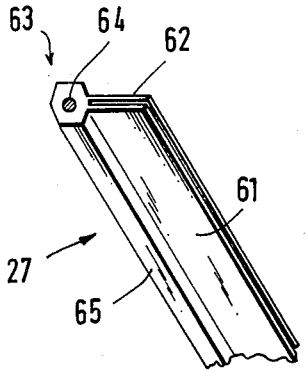
Figure 2:
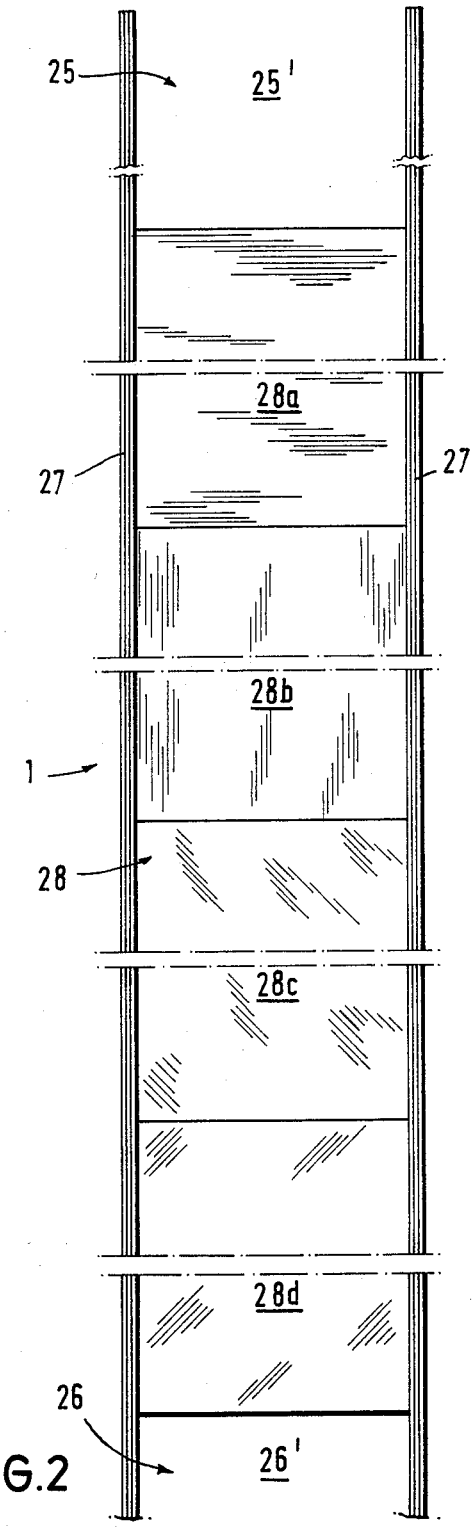

FIG. 1 is a cross section of the present device in which the webs of the flexible wall extend between two window panes, FIG. 2 is a plan view of the flexible wall comprising a leader and a final portion, FIG. 3 is a perspective view of the wall guiding profile, FIG. 4 is a cross section of a guide rail for several webs, including a guide element, a tensioning element, the wall guiding profile and part of the web material, FIG. 5 is a cross section along line V—V of FIG. 1 and FIG. 6 is a scaled-up drawing of FIG. 2.

The embodiment shown in FIG. 1 illustrates the use of a device for the thermal insulation of a window surface. There is provided above the window opening an upper box 3 comprising winding means for a flexible wall 1, a lower box 11 containing deviating and driving means being mounted beneath the window surface. The window opening is limited by two window panes 2 between which a space 30 is left to permit to introduce once or repeatedly the flexible wall 1.

As obvious from FIG. 2, the flexible wall consists of a flexible web material 28 (sheet), and of wall guiding profiles 27 limiting bilaterally at the longitudinal edges the web material 28 which consists of different, successively fitted materials 28, **28*b*, 28*c*, 28*d* of varying properties of transparency, reflection and absorption, it being possible to adopt an order of materials such that specific combinations of web material 28 in different webs can be introduced into the space 30**.

The wall guiding profiles 27 each extend each beyond the end of the flexible web material 28 to thus form a leader 25 and a final portion 26. Within the range of the latter, there are openings 25' and 26' free from web material 28.

According to FIG. 3, the wall guiding profile 27 includes a protective strip 61 and a hexagonal portion 63, the protective strip 61 being provided with a slot 62 to fasten the web material 28. The hexagonal portion 63 is fitted at the side of the protective strip 61 averted from the web material 28. To receive the tensile stresses, the thicker portion 63 contains a central reinforcing core 64. The honeycomb structure of the thicker portion with the surfaces 65 in parallel to the web material 28 ensures a perfect superposition of several guiding profiles 27 during the winding operation and a constant distance between the individual layers of the flexible wall 1 thus avoiding contacting of the web material 28 when being wound up. Moreover, the other obliquely extending sides of the honeycomb portion 63 permit centering of the wall guiding profile in all guiding means.

The guiding means comprises two guiding rails 36 shown in FIG. 4 and limiting laterally in the range of the window panes 2 the space 30 as well as permitting a rectilinear guidance of the flexible wall 1 over the wall guiding profiles 27 which are sliding in the guiding rails 36 which consist of hollow profiles of which each has four guidances **36*a*,36*b*,36*c*,36*d*. Each of the guidances consists of a chamber 72 having a longitudinal slot 60**.

The wall guiding profiles receiving the web material 28 slide 1 in the guidances **36*a*,36*b*,36*c*,36*d* in guide elements 70 provided additionally in the chambers 72 and having a hollow profile adapted to the outer contour of the wall guiding profile 27**.

The mentioned guide elements—of which only one is shown in the guidance **36*b* of FIG. 4 for the sake of clarity-slide in parallel to the web material 28 in the respective chamber 72. On the side facing the web material 28, they contain tensioning elements 71 secured in the guidances 36*a*,36*b*,36*c*,36*d*, e.g. a spring forming one piece with the guide element 70 and bonded on the side walls of slot 60 to find its support so that the web material 28 is drawn with the wall guiding profiles 27 into the guidances 36*a*,36*b*,36*c*,36*d*. At the same time, the protective strip 61 of the wall guiding profile 27 is always in the slots 60 of the guidances 36*a*,36*b*,36*c*,36*d*. It is very important for the web material 28 to be kept tensioned in the guidances of the guide rails 36 because the web material may be elongated considerably under heat action in the path of light and heat radiation thus resulting in an uneven web material layer with deflections thereof, unless it is kept tightened. This is particularly undesirable if the web material 28** also consists of transparent sheets because refraction of light will be changed and the view to the outside may be distorted accordingly.

The winding means of FIG. 1 consists of one roller 4 or 5 which is driven by a spring motor 40 or 50 permitting a winding of the flexible wall 1 onto the respective roller 4,5. Both spring motors are operating in opposite directions so that the flexible wall 1 is constantly kept tightened between the rollers 4,5.

In the initial position as shown in FIG. 1, the predominant part of the flexible wall 1, i.e. the final portion as well as the range provided with web material 28, is wound on roller 4, the leader 25 extending subsequently thereto from roller 4 via the total repeatedly deviated course of the path of the flexible wall as far as to roller 5, as will be explained hereunder.

To deviate the flexible wall 1, use is made of guiding and deviating means which extend along the lateral edges of the flexible wall 1 so that the wall guiding profiles secured to the edges of the flexible wall 1 may be received by them. To this end, guiding, pressing and deviating rollers 6 to 10 and 12 to 15 contain circumferential profiles ensuring that the wall guiding profiles 27 of the flexible wall 1 are received halfwise, divided in the plane of the web material 28.

The guiding, pressing and deviating rollers 6 to 10 or 12 to 15 are arranged symmetrically, i.e. in pairs, spaced by the width of the flexible wall 1. Except for the deviating or redirecting roller 13 driven by electric motor 76, they have no through shafts but they are supported at the lateral walls 75 of the upper box 3 or of the lower box 11 to be axially displaceable on stationary pins 78. Thus, probable changes in width of the flexible wall 1 can be compensated not only by the guide elements 70 in the guide rails 36, but also by the guiding, pressing and deviating rollers.

The flexible wall 1 unwound from roller 4 is directed first to the guide rollers 10 having the function of modifying into a constant feed or discharge angle the varying tangential feed or discharge angle of the flexible wall 1 being dependent upon the package diameter. To this effect, guide roller 10 conducts the flexible wall 1 into the first guidances 36 of the guide rails 36. Ahead of the inlet into the first guidances **36*a* of the guide rails 36, a stripping and antistatic brush 35 is mounted to extend transversely to the guide rails 36 and in parallel to the web material plane. The stripping and antistatic brush 35 divided in parallel to the flexible wall 1 is arranged to be halfwise before and halfwise behind the flexible wall 1 to permit bilaterally cleaning and electrostatically discharging of the web material 28 running into the first guidance 36*a***.

The window panes 2 and the guide rails 36 form in common a square-shaped interspace 30 through which the webs 51 to 54 of the flexible wall are repeatedly conducted to and fro. In the embodiment, four guidances **36*a*,36*b*,36*c*,36*d* are provided in the guide rails 36 thus permitting division of the interspace 30 by four webs 51 to 54 at most, and for the formation of heat insulating chambers, to seal it tightly to the outside and inside by the window panes 2, in lateral direction by the guide rails 36 and to the top and to the bottom by the upper box 3 and the lower box 11**.

Through the guidances **36*a*, the flexible wall 1 gets into the lower box 11 in which the deviating rollers 12 and 13 with the associated pressing rollers 14 and 15 are so mounted that the axes of the pressing and deviating rollers are situated on an imaginary line a which is inclined towards the course of the parallel webs 51 to 54. To save space, the pressing and deviating rollers 12 to 15 are nearly superimposed so that their diameters may be larger than the interspaces between the webs 51 to 54. The axle centers of the deviating and pressing rollers 12 to 15 are offset along the imaginary line a through the axle centers so that delivered and discharged webs of the flexible wall 1 exactly run into the spaced guidances 36*a*,36*b*,36*c*,36*d* of the guide rails 36. By a different inclination of the common plane a of the axes of the pressing and deviating rollers 12 to 15, there may be obtained other distances between the individual webs 51 to 54 of the flexible wall 1 in the interspace 30. The mutual distance at the periphery of the pressing and deviating rollers 12 to 15 ensures that the wall guiding profile of the flexible wall 1 fits positively into the profile 16 of the respective adjacent roller (FIGS. 5 and 6). Half of the wall guiding profile 26 is always received by profile 16 so that the wall guiding profile 27 is completely enclosed at said points of contact, and the flexible wall 1 cannot leave the guidances. The pressing and deviating rollers 12 to 15** have identical diameters so that the peripheral speeds of all rollers are identical. The sense of rotation of adjacent rollers is opposite.

The circumferences of deviating and pressing rollers 12 to 15 provided in the lower box 11 are fitted each, in addition and adjacent to the profile 16, with intercoupled toothed rims 17. The deviating or redirecting rollers 13 interconnected by shaft 77 are driven by said shaft 77 via an electric motor 76 changeable in its sense of rotation and having a reduction gear, the motor being mounted externally at the lower box 11 with, the shaft being supported in the lateral outer walls 75. All of the rollers are positively driven as well by the toothing 17 of the redirecting and pressing rollers 12 to 15.

The ends of the guide rails 36 projecting into the lower box 11 extend obliquely to the parallel webs 51 to 54. They are substantially adapted to the inclination of the imaginary line a extending through the axes of the pressing and deviating rollers 12 to 15. Thus, directly upon its tangential lifting from the deviating and pressing rollers 12 to 15, the flexible wall 1 is running into the guidances **36*a*,36*b*,36*c*,36*d***.

The flexible wall discharged from the first guidances **36*a* is redirected via the pressing rollers 14 and the deviating rollers 12 and conducted to the guide rails 36 in order to enter guidances 36*b*. When leaving the latter, it gets again into the upper box 3 in which the deviating rollers 6 as well as the pressing rollers 7 and 8 are mounted on a second imaginary line b extending through their axes in parallel to the first imaginary line a. Via the wall guiding profiles, another guide roller 9 the axis of which is not on the imaginary line b engages the deviating rollers 6. The guiding, pressing and deviating rollers 6 to 10 in the upper box 3 also have identical diameters, similar to the pressing and deviating rollers 12 to 15 in the lower box. Their circumference is provided with the profile 16. However, in contradistinction to the pressing and deviation rollers 12 to 15, they do not have a toothed rim 17 in addition to the profile 16**.

The flexible wall 1 discharged from the guidances **36*b* is conducted via the deviating roller 6 and the pressing roller 7 into the guidances 36*c* and from there, in the lower box 11, via the pressing rollers 15 and the deviating rollers 13, into the last guidances 36*d*. Upon leaving the latter, it gets via the pressing rollers 8 and 7 and the guide roller 9 onto roller 5 to be wound up there. Similar to guide rollers 10, it is the duty of guide rollers 9 to care for a constant feed and discharge angle in relation to the pressing rollers 7, because, otherwise, said angle would be dependent upon the thickness of the package on the roller 5. Like roller 4, roller 5 is so dimensioned that it may accept the total windable portion of the flexible wall 1. If the distance of the axes of rollers 4,5 is smaller than to double the maximum package diameter, so that the package of the roller carrying the total windable portion of the flexible wall extends into the winding range of the respective other roller, it will be probably necessary to mount additional guide rollers, for instance on the side of the flexible wall 1 opposite to the guide rollers 10**.

To ventilate the interspace 30, which may be subdivided by webs 51 to 54, the underside of the lower box 11 is provided with ventilation slots 20 to supply air, while the upper region of the upper box 3 is provided with slots 21 for waste air. To avoid air circulation, the slots 20, 21 may be closed. In place of ventilation slots 20, 21, there may be also provided terminals for not illustrated air conduits which permit a controlled ventilation of the interspace 30 by means of sensors. Thus, in summer, warm air may be conducted to the outside from air chambers formed by webs 51 to 54, or it may be delivered to a heat pump.

Upon actuating the device via shaft 77 of the electric motor, the deviating rollers 13 and deviating and pressing rollers 15,12 and 14 mechanically coupled therewith, the flexible wall 1, initially substantially wound on roller 4, is unwound in the one sense of rotation of the motor. At the same time, the spring motor 40 being relaxed in wound-up condition of roller 4, is tensioned. Hence, the flexible wall gets from roller 4, via guide rollers 10, into the first guidances 36*a* of the guide rails 36, and, from there, to the driven pressing and deviating rollers 14,12. The wall guiding profiles of the flexible wall 1 embrace a great part of the periphery of said pressing and deviating rollers, in particular deviating rollers 12 and 13. Thus, a good transmission of the tractive forces from the driven pressing and deviating rollers 12 to 15 to the wall guiding profiles is realized. Upon its deviation by the deviating rollers 12, the flexible wall gets into the guidances 36*b* to be redirected finally in the lower box by deviating rollers 6 and pressing rollers 7 into the guidances 36*c* while it is conducted finally in the lower box 11 by the pressing rollers 15 and the deviating rollers 13 into the guidances 36*d*. When the flexible wall 1 has left the deviating rollers 13, the tractive forces for the transport of the wall towards roller 5 are not exerted any longer by the drive motor 76, but by the spring motor 50 which is tensioned in unwound condition of roller 5. Upon its discharge from the guidances 36*d*, the flexible wall 1 is redirected by the pressing rollers 7,8 to get via the guide roller 9 to roller 5. If the sense of rotation of the drive motor 76 is reversed, the direction of movement of the flexible wall 1 may be reversed as well while roller 5 is unwound and the spring motor 50 now operating against the drive motor 76 is tensioned. With the aid of the tensioned spring motor 40, roller 4 is winding up again the flexible wall 1 delivered via the guide rollers 10.

What is claimed is:

1. An insulating apparatus for use in a region between a structural assembly defining a region between two opposing, comprising;

a windable, flexible wall means having the longitudinal sides thereof provided with wall guiding profile members; said wall guiding profile members extending beyond the length of said flexible wall means at both ends thereof;

first and second means arranged at one end of the structural assembly simultaneously playing out and winding up said flexible wall means; the rotation of said first winding means being opposite the rotation of said second winding means;

means, stationarily arranged at the other end of the structural assembly, receiving said flexible wall means from said first winding means and deviating said flexible wall means into a reverse direction to be wound by said second winding means; and at least one guide means for receiving said wall guiding profiles;

whereby at least one layer of said flexible wall means is contained in the region between two opposing surfaces of the structural assembly.

2. The apparatus according to claim 1 wherein the distance between the first and second winding means is smaller than the sum of the maximum radii of the wound-up package of the flexible wall means.

3. The apparatus according to claim 1, wherein the wall guiding proflies consist of two protective strips forming a slot to receive the flexible wall means, and of a bilaterally flattened bulge in parallel to the flexible wall means at the side averted from the slot.

4. The apparatus according to claim 3, wherein the bulge contains a central reinforcing core to receive tractive forces.

5. The apparatus according to claim 3, wherein the bulge is a honeycomb-type hexagonal profile.

6. The apparatus according to claim 1, wherein the wall guiding profiles are laterally displaceable in the guide means in the plane of the flexible wall means.

7. The apparatus according to claim 1, wherein there are guide elements provided in the guide means to receive the wall guiding profiles which are supported by tensioning elements at slot edges of the guide means.

8. The apparatus according to claim 1, wherein the spaces surrounding the flexible wall means are ventilated.

9. The apparatus according to claim 1, further comprising a shipping and antistatic brush near a first guide means.

10. The apparatus according to claim 1, wherein the means for receiving and deviating said flexible wall means comprises at least two pairs of rollers.

11. The apparatus according to claim 10, wherein a pressing roller pair which determines the course of a section of wall guiding profiles leading to the pair of deviating rollers is associated with at least one of the pairs of deviation rollers.

12. The apparatus according to claim 11, wherein the pairs of pressing rollers are profiled to receive the wall guiding profile.

13. The apparatus according to claim 10, which further comprises at least one pair of rollers provided at the first end to receive said flexible wall means from said rollers at the other end and reverse the direction of said flexible wall means so that the flexible wall means can be wound by the second winding means.

14. The apparatus according to claim 13, wherein the circumferential faces of the rollers are profiled for the receipt of the wall guiding profiles.

15. The device according to claim 1, wherein the first and second winding means for simultaneously playing out and winding said flexible wall mean are arranged at opposite ends of the structural assembly and the rotational axis of said first winding means is the same as the rotational axis of the second winding means.

16. An insulating device in combination with a structural assembly defining a region between two opposing surfaces thereof being insulated by said device, comprising:

a windable flexible wall means;

first and second means arranged at the ends of the structural assembly simultaneously playing out and winding up said flexible wall means;

a first plurality of roller means arranged at one end of the structural assembly, receiving said flexible wall means into a first reverse direction, axes of rotation of said first plurality of roller means being arranged in an inclined relationship; and a second plurality of roller means arranged at the other end of the structural assembly receiving said flexible wall means from said first plurality of roller means directing said flexible wall into a second reverse direction, axes of rotation of said second plurality of roller means being arranged in an inclined relationship;

whereby a plurality of spaced-apart layers of said flexible wall means is formed in the region between the two opposing surfaces to provide a plurality of tightly closed air chambers.

17. The device according to claim 16, wherein the first and second means for simultaneously playing out and winding up said flexible wall means are arranged at the same end of the structural assembly and the rotation of said first winding means is opposite to the rotation of said second winding means.

18. The device according to claim 16, wherein the inclined relationship of the axes of rotation of said first plurality of roller means is substantially parallel to the inclined relationship of the axes of rotation said second plurality of roller means.

* * * * *